US006220249B1

(12) United States Patent
Park

(10) Patent No.: US 6,220,249 B1
(45) Date of Patent: Apr. 24, 2001

(54) WIGS HAVING LENGTH ADJUSTING PARTS

(75) Inventor: Hun Sik Park, Seoul (KR)

(73) Assignee: Pt. Pigeon Dongan Indonesia, Bekasi (ID)

( * ) Notice: Subject to any disclaimer, the term of this patent is extended or adjusted under 35 U.S.C. 154(b) by 0 days.

(21) Appl. No.: 09/168,868

(22) Filed: Oct. 9, 1998

(30) Foreign Application Priority Data

Sep. 24, 1998 (KR) ..... 98-39763

(51) Int. Cl.[7] ..... A41G 3/00; A41G 5/00
(52) U.S. Cl. ..... 132/53; 132/54; 132/201
(58) Field of Search ..... 132/53, 54, 55, 132/56, 274, 201, 200

(56) References Cited

U.S. PATENT DOCUMENTS

| | | | | |
|---|---|---|---|---|
| 1,853,976 | * | 4/1932 | Jacoby et al. | 132/53 |
| 3,444,865 | * | 5/1969 | De Vita | 132/53 |
| 3,812,867 | * | 5/1974 | Wanderman et al. | 132/53 |
| 3,835,867 | * | 9/1974 | Molinario | 132/53 |
| 4,509,539 | | 4/1985 | Alfieri | 132/53 |
| 4,825,886 | * | 5/1989 | Allen | 132/54 |
| 5,085,233 | * | 2/1992 | Motoori et al. | 132/54 |

FOREIGN PATENT DOCUMENTS

| | | | | |
|---|---|---|---|---|
| 1388300 | * | 3/1975 | (GB) | 132/53 |

* cited by examiner

*Primary Examiner*—John J. Wilson
*Assistant Examiner*—Robyn Kieu Doan
(74) *Attorney, Agent, or Firm*—Stevens, Davis, Miller & Mosher, LLP.

(57) ABSTRACT

Disclosed is a wig including a wig base and a plurality of hairs outwardly sewn on a surface of the wig base, comprising monotapes affixed to a front portion of the wig base, and a plurality of length adjusting parts disposed at the a back portion of the wig base which adjusts the length of the front and back of the weared wig, in order to freely adjust the length of the wig and improve a wearing effect of the wig. Also, the present invention is composed of the front portion having the monotapes and the side portion having elastic bands.

15 Claims, 3 Drawing Sheets

WIGS HAVING LENGTH ADJUSTING PARTS

BACKGROUND OF THE INVENTION

The present invention relates to a wig to which length adjusting parts are attached, and more particularly, to a wig including a plurality of adjusters or adjusting bands capable of adjusting the length of the wig, which are attached to a back portion of the wig.

Generally, there are wigs for totally or partly covering the head or a wig for a bald head. A wig is composed of a wig base having an outwardly curved surface arranged in a shape of wearer's head and a plurality of hairs affixed to the wig base. The wig base is generally made by nylon yarn and polyester yarn, or is manufactured in the fashion of a net or a network structure made by polyurethane yarn and polycarbonate yarn, etc, or is made with an artificial skin formed by soft synthetic resins such as polyurethane, polycarbonate, etc. There have been used a natural hair, an artificial hair or a mixed hair as wig hair. On the wig base made in the fashion of a net or a network structure, a plurality of hairs made of natural hairs and/or artificial hairs are tied to from a wig. The hairs are fixed on the wig base so that a pair of hairs are protruded above the surface of the wig base. The wig base made by the soft artificial skin has a similar structure to that of the wig base made in the shape of the net or network structure.

In case where hairs are fixed on or attached to the net-shaped wig base, an attachment direction or orientation of the hairs is variously selected, and a variety of knots in hairs are provided to prevent the knots from being loose.

FIG. 1 is a perspective view showing a conventional wig in which a plurality of hairs are affixed to a net-shaped wig base. As shown in FIG. 1, a conventional wig 10 includes a wig base 11 having a curved surface of an outwardly protruded shape, a plurality of hairs 13 attached to the wig base 11, an ear support 15 attached to the bottom of a side portion of the wig base 11, and a back end adjusting part 17 attached to the bottom of a back portion of the wig base 11. A wearer of the wig properly selects the wig according to his/her tastes in hair colors and the size of his/her head. After wearing the wig, the wearer tightens the wig to fit closely around his/her head and not to be easily uncovered or moved.

However, since the back end adjusting part 17 is commonly formed with a Velcro fastener, only a lower portion of the wear's wig is adjusted to fit to his/her head. Therefore, when having the projected forehead or a slightly abnormal shape of the head, the user should wear the wig hair even though such an arrangement causes any inconvenience, because the length of the front and back of the wig cannot be adjusted.

Also, the wig's wearer adjusts only the back end adjusting part 17 so as to suit the wig to his/her head. Therefore, after wearing the wig by adjusting the back end adjusting part 17, the wearer should continuously wear the wig even if he/she feels any difficulty due to non-elasticity in a weared condition.

SUMMARY OF THE INVENTION

In order to solve the problems, an object of the present invention is to provide a wig having length adjusting parts, capable of adjusting the length of the wig according to shapes of wearer's head and increasing a wearing effect of the wig.

To accomplish the above object of the present invention, there is provided a wig including a wig base made by an artificial skin and/or a net having an outwardly curved surface, and a plurality of hairs outwardly sewn on the curved surface of the wig base, comprising:

monotapes, affixed to a front portion of the wig base; and a plurality of length adjusting parts, disposed at a back portion of the wig base, for adjusting the length of the front and back of the weared wig.

It is preferable that the net forming the wig base is made by filament yarn coated with colors similar to the color of the skin of a wearer's head. Also, the length adjusting parts are adjusting bands or adjusters.

To achieve the above object of the present invention, there is provided a wig including a wig base made by an artificial skin and/or a net having an outwardly curved surface, and a plurality of hairs outwardly sewn on the curved surface of the wig base, comprising:

monotapes, affixed to a front portion of the wig base; and an elastic band, attached to the side of the wig base.

A plurality of length adjusting parts which can adjust the length of the front and back of the weared wig are further disposed at the back of the wig base.

It is preferable that the elastic band which is disposed at the side of the wig base is a wool-made band formed between the front portion and an ear support, and that the net forming the wig base is made by filament yarn coated with colors similar to the color of the skin of a wearer's head.

Also, in case that the wig base is manufactured with an artificial skin, it is preferable that the skin is made by using one of a transparent resin or a semi-transparent resin colored by one of the color of the skin or milk-white color.

BRIEF DESCRIPTION OF THE DRAWINGS

The preferred embodiments are described with reference to the drawings wherein.

DETAILED DESCRIPTION OF THE PREFERRED EMBODIMENTS

Preferred embodiments of the present invention will be described below in more detail with reference to the accompanying drawings.

Figure 1:
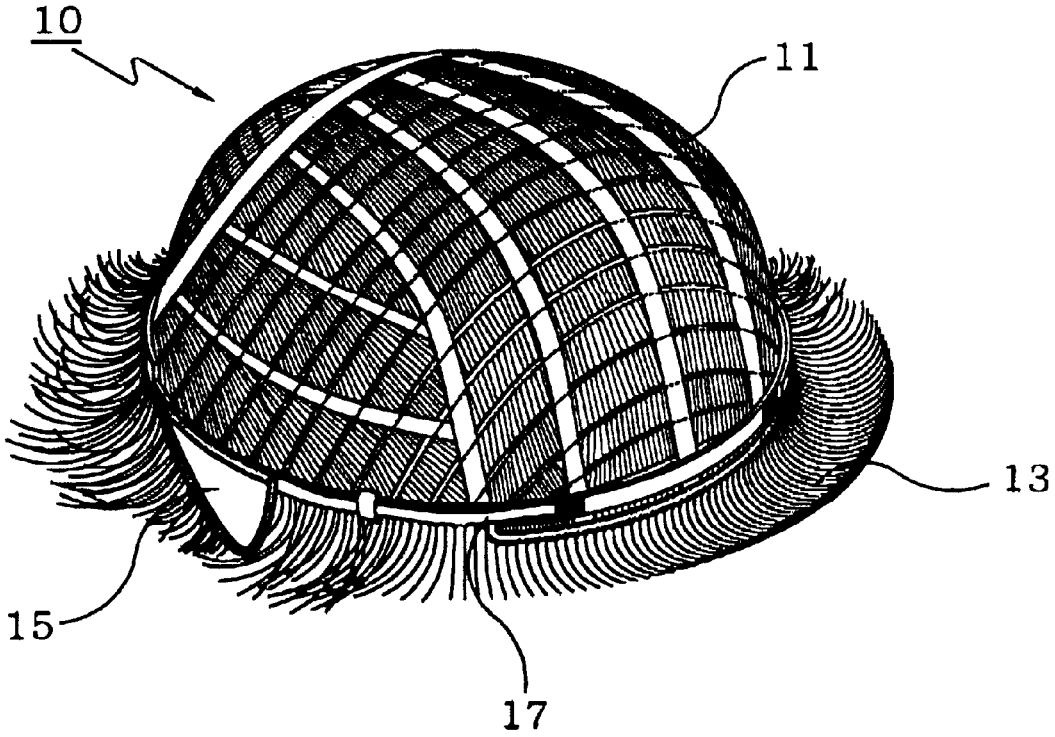
FIG. 1(PRIOR ART)
FIG. 1 is a perspective view showing a conventional wig in which a plurality of hairs are affixed to a net-shaped wig base.
Figure 2:
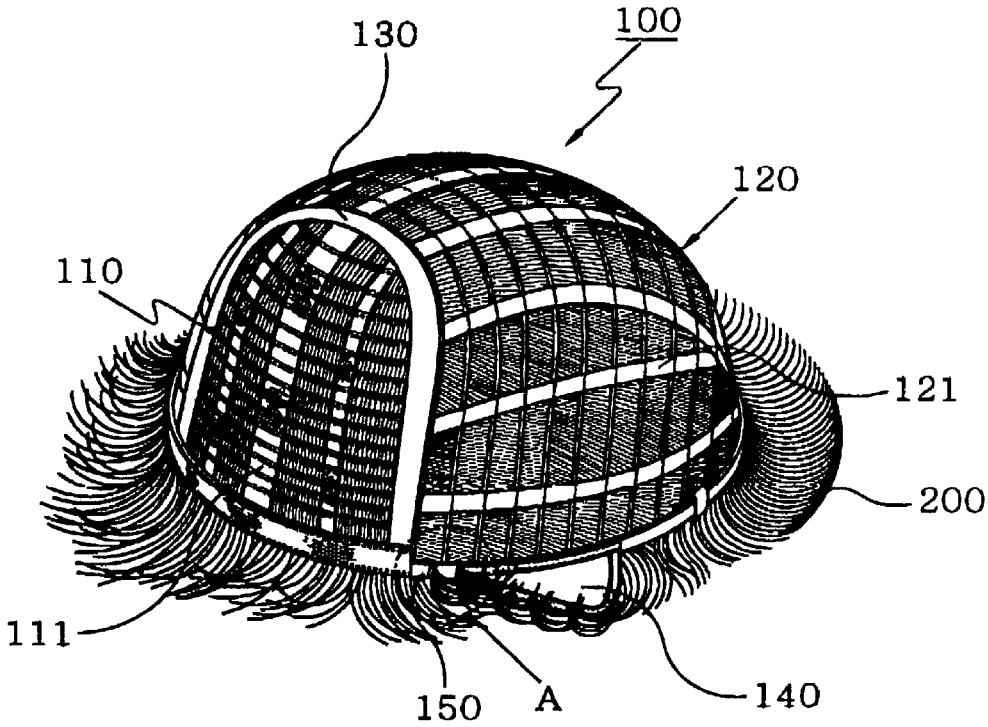
FIG. 2 is a schematically perspective view showing mainly a front portion of the wig according to the present invention.

FIG. 2 is a schematically perspective view showing mainly a front portion of the wig according to one embodiment of the present invention. As shown in FIG. 2, the wig is composed of a wig base 100 having an outwardly curved surface and a plurality of hairs 200 adhered to the curved surface of the wig base 100. Materials constituting the wig base 100 are mainly classified into two parts. First, a front portion directly contacting the forehead or skin of a wearer when wearing the wig, is formed with monotapes 111 having a loose texture. That is, the monotapes 111 are affixed at a constant interval in a vertical direction centering the upper portion of the wig base 100, and also attached to the lower portion thereof in order to finish a lower end of the wig base

100. To a back portion 120 at which the back of the wearer's head is placed, bands 121 being a material of the conventional wig base are affixed approximately across the affixation direction of the monotapes 111 of the front portion 110. An adhesive member such as an adhesive sheet is attached to a portion where the front portion 110 and the back portion 120 are across each other, in order to connect the front portion 110 and the back porting 120. Thus, such a treatment can prevent any skin troubles to be caused when a synthetic fiber of the wig's material contacts the human skin.

Also, to further increase a natural viewing effect when wearing the wig, it is preferable to manufacture the wig base 100 by filament yarn coated with colors similar to the skin color of the wearer's head. Additionally, when the wig base 100 is formed with an artificial skin, it is preferable to manufacture the skin with one of a transparent resin or a semi-transparent resin colored with one of a color of the skin or a milk-white color.

Figure 3:
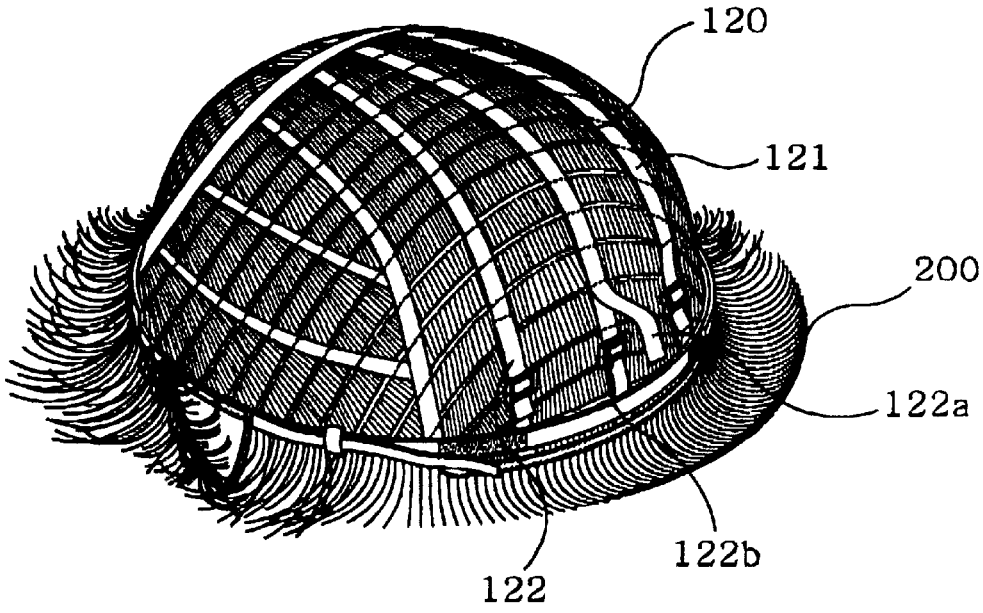
FIG. 3 is a schematically perspective view showing mainly a back portion of the wig according to the present invention.

To the back portion 120 of the wig base 100, a plurality of length adjusting parts 122 capable of adjusting the length of the front and back of the wig according to the shape of the wearer's head are attached, which can be seen in FIG. 3 mainly illustrating the back portion of the wig according to the present invention.

In FIG. 3, the length adjusting parts 122 are affixed to the lower portions of the bands 121 constituted in the back portion 120 of the wig base 100. The length adjusting parts 122 include adjusting bands 122*a* of which one end is attached to the lower portion of the band 121, and pieces 122*b* of a link shape having a function of adjusting the length of the band 122 by connecting one end of the adjusting band 122*a* with the other end thereof which is placed at a further lower portion of the adjusting band 122*a*. This embodiment describes the adjusting band 122 as an example of the length adjusting part, but any part having a length adjusting function such as an adjuster can be used as the length adjusting part 122, with attachment to the adjusting band.

Figure 4:
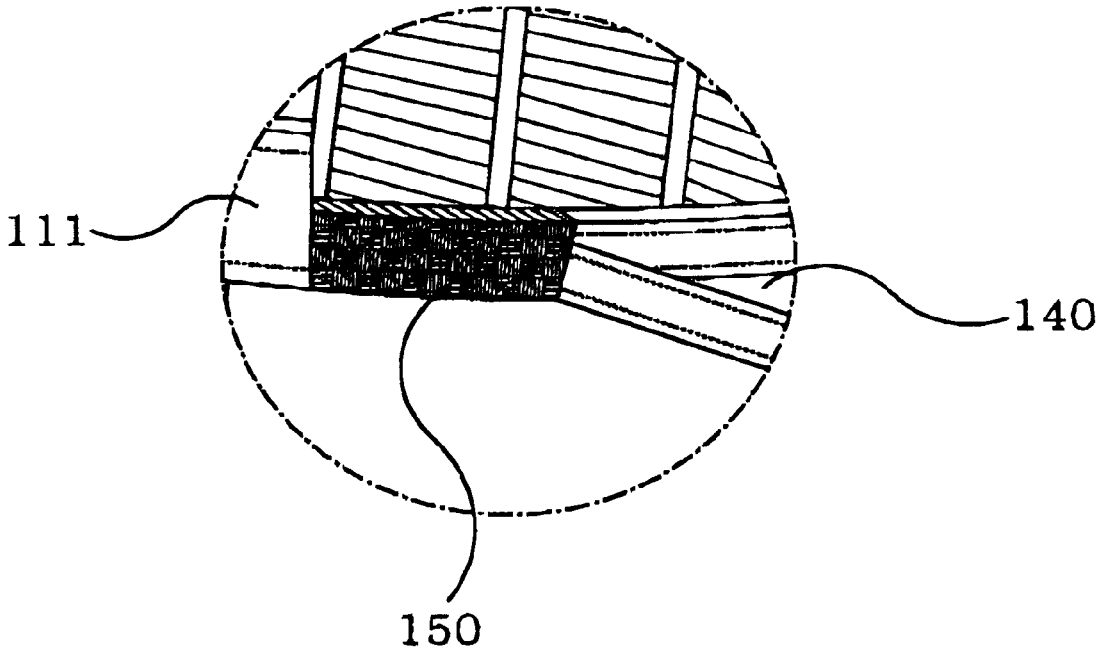
FIG. 4 is an enlarged sectional view showing a portion "A" of FIG. 2

Another embodiment of the present invention can constitute the side of the wig base 100 with an elastic band 150. FIG. 4 is an enlarged sectional view showing a portion "A" of FIG. 2, which in detail shows the elastic band 150. That is, a portion between the front portion 110 and an ear support 140 of the wig base 100 which is positioned around the wearer'3 s ear when wearing the wig, is made by an elastic material, and thus it is prevented that the lower portion of the wig base 100 presses around the ear during wearing. A wool-made band is preferred as the elastic band 150, but any materials having elasticity can be used.

In this embodiment, a plurality of length adjusting parts 122 can be additionally attached to the back portion 120 of the wig base 100 as described in the above embodiment.

As described above, the present invention provides the wig of which the length can be freely adjusted by a wearer when wearing the wig, and which can solve any difficulty due to the pressure that the wearer feels during wearing the conventional wig. Also, the present invention provides an effect that the wig's hair looks like natural human hair by coloring materials of a wig base with colors similar to the color of the head skin.

While only certain embodiments of the invention have been specifically described herein, it will be apparent that numerous modifications may be made thereto without departing from the spirit and scope of the invention.

What is claimed is:

1. A wig including a wig base comprising an artificial skin and/or a net having an outwardly curved surface, and a plurality of hairs outwardly sewn on the curved surface of the wig base, comprising:

monotapes affixed to a front portion of the wig base; and a plurality of length adjusting means, disposed at a back portion of the wig base, for adjusting the length of the front and back of the weared wig;

wherein the monotapes are only located on the front portion of the wig.

2. The wig according to claim 1, wherein the net forming the wig base is made by filament yarn coated with colors similar to the color of the skin of a wearer's head.

3. The wig according to claim 1, wherein the length adjusting means are adjusting bands or adjusters.

4. A wig including a wig base comprising an artificial skin and/or a net having an outwardly curved surface, and a plurality of hairs outwardly sewn on the curved surface of the wig base, comprising:

monotapes affixed to a front portion of the wig base; and an elastic band, attached to a side of the wig base wig;

further comprising a plurality of length adjusting means, disposed at the back of the wig base, which can adjust the length of the front and back of the weared wig;

wherein the monotapes are only located on the front portion of the wig.

5. The wig according to claim 4, wherein the elastic band which is disposed at the side of the wig base comprises wool and an elastic material formed between the front portion and an ear support.

6. The wig according to any one of claim 4, wherein the net forming the wig base is made by filament yarn coated with colors similar to the color of the skin of a wear's head.

7. The wig according to any one of claim 4, wherein an artificial skin forming the wig base is manufactured by using one of a transparent resin or a semi-transparent resin colored by one of the color of the skin or milk-white color.

8. The wig according to claim 1, wherein knots of the hair are formed on the monotapes.

9. The wig according to claim 1, wherein the monotapes are vertically oriented on the front portion of the wig.

10. The wig according to claim 1, wherein an adhesive member attaches the front portion to the back portion.

11. The wig according to claim 1, wherein the length adjusting parts are only attached to the back portion.

12. The wig according to claim 4, wherein the knots of hair are formed on the monotapes.

13. The wig according to claim 12, wherein the monotapes are vertically oriented on the front portion of the wig.

14. The wig according to claim 4, wherein an adhesive member attaches the front portion to the back portion.

15. The wig according to claim 4, wherein the length adjusting parts are only attached to the back portion.

* * * * *